US006404119B1

(12) United States Patent
Hidaka et al.

(10) Patent No.: US 6,404,119 B1
(45) Date of Patent: Jun. 11, 2002

(54) COLOR CATHODE RAY TUBE HAVING A REDUCED DIAMETER PART IN THE NECK

(75) Inventors: Tadachika Hidaka; Masahiro Ueda; Yoshiaki Yanai; Nobumitsu Aibara; Shinji Arai, all of Shiga (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/163,695

(22) Filed: Sep. 30, 1998

(30) Foreign Application Priority Data

Sep. 30, 1997 (JP) ..... 9-265313

(51) Int. Cl.[7] ..... H01J 31/00; H01J 29/76

(52) U.S. Cl. ..... 313/477 R; 313/44 Q; 220/2.3 A

(58) Field of Search ..... 313/440, 318.05, 313/421, 431, 477 R; 335/210; 220/2.3 A, 2.1 A

(56) References Cited

U.S. PATENT DOCUMENTS

| | | | | |
|---|---|---|---|---|
| 3,163,794 A | | 12/1964 | Bloomsburgh | |
| 4,712,080 A | * | 12/1987 | Katou | 335/213 |
| 5,514,931 A | * | 5/1996 | Dasgupta et al. | 313/440 |
| 5,763,995 A | * | 6/1998 | Sano et al. | 313/477 R |
| 5,777,430 A | * | 7/1998 | Ueda et al. | 313/477 |
| 5,801,480 A | * | 9/1998 | Kawaguchi et al. | 313/440 |
| 5,801,481 A | * | 9/1998 | Yokota | 313/440 |
| 6,087,767 A | * | 7/2000 | Sano et al. | 313/440 |

FOREIGN PATENT DOCUMENTS

| | | |
|---|---|---|
| JP | 48-90673 | 1/1973 |
| JP | 3-35646 | 4/1991 |
| JP | 3-192636 | 8/1991 |
| JP | 4-126659 | 11/1992 |

* cited by examiner

*Primary Examiner*—Nimeshkumar D. Patel
*Assistant Examiner*—Karabi Guharay
(74) *Attorney, Agent, or Firm*—Scully, Scott, Murphy & Presser

(57) ABSTRACT

A color cathode ray tube apparatus is provided to reduce the amount of deflection power required, this apparatus having a panel part, on the inside surface of which is formed a phosphor film that emits three primary colors, a funnel part that has its expanded aperture joined to the panel part and a funnel-shaped part, a neck part in which is housed an electron gun structure, and which is joined to the reduced-diameter $\phi$ a aperture of the funnel part, and a deflection yoke that is disposed between the funnel part and the neck part, the neck part being formed by a main part that houses the electron gun structure and a reduced-diameter part to which are attached the deflection yokes. The funnel part has a quadrangular pyramid shape at the end that is joined to the neck part, and this can also be used for attachment of the deflection yoke.

14 Claims, 9 Drawing Sheets

COLOR CATHODE RAY TUBE HAVING A REDUCED DIAMETER PART IN THE NECK

BACKGROUND OF THE INVENTION

1. Field of the Invention

The present invention relates to a color cathode ray tube apparatus and a method for manufacturing a color cathode ray tube apparatus, and more specifically it relates to a color cathode ray tube apparatus that is suitable for mounting of a deflection yoke thereto, and a method of manufacturing the above-noted color cathode ray tube apparatus.

2. Description of Related Art

A color cathode ray tube apparatus 41 of the past, as shown in FIG. 16 and FIG. 17, is made up of a color cathode ray tube 42 and a deflection yoke 51. The color cathode ray tube 42 is made up of a panel part 43, onto the inside surface of which is formed a phosphor film 43*a*, a funnel part 47, which includes a shadow mask structure 46 that includes a shadow mask 44 and a frame 45, and a neck part 48, which houses an electron gun structure 50 that emits 3 electron beams.

An electron beam 50*a* is deflected by a magnetic field from the deflection yoke 51, passes through the shadow mask 44, and causes light to be emitted by the phosphor film 43*a*, thereby displaying an image on the panel screen.

The phosphor film 43*a* on the inside surface of the panel part 43 is formed by phosphors for the three primary colors, red, green, and blue, and in order to cause these phosphors to emit light, an electron gun structure 50, which includes three cathodes that emit an electron beam 50*a*, in an in-line arrangement, is housed within the neck part 48.

In order to deflect the three electron beams 50*a* that are emitted from the electron gun structure 50 in the horizontal direction and the vertical direction, a deflection yoke 51, which includes a horizontal deflection coil 51*a* and a vertical deflection coil 51*b* that generate a magnetic field, is attached to the region of the joint between the funnel part 47 and the neck part 48.

The magnetic field that is generated by the deflection yoke deflects the electron beams 50*a* so as to display a desired image on the screen.

The deflection electrical power of the color cathode ray tube apparatus 41 is largely governed by the horizontal deflection electrical power of the deflection yoke 51. This horizontal deflection power PH is established by the following equation, which expresses this deflection power as a function of the inner diameter Dc of the envelope inner surface of the deflection coil 51*a* and the length Lc of the deflection coil 51*a* that forms the deflection yoke 51, the accelerating potential Eb applied to the electron gun 50, the frequency fH of the horizontal deflection coil, and the horizontal deflection angle θH of the electron beam 50*a*.

$$PH\ fH \times Dc \times Eb \times \sin^2(\theta H/2)/Lc \quad (1)$$

From the above-noted relationship, it can be seen that the making of the horizontal deflection power PH small is determined by the accelerating potential Eb that is applied to the electron gun structure 50, the length Lc of the horizontal deflection coil 51*a* and the inner diameter Dc of the envelope thereof.

If the accelerating potential Eb is made small, the velocity of electrons which impinge on the phosphor film 43*a* of the panel part 43 is made small, so that the focus characteristics of the image formed with a reduced intensity worsen.

In a usual color cathode ray tube apparatus 41, the accelerating potential Eb that is applied to the electron gun structure 50 is 18 kV or greater, and is usually approximately 25 kV. Note also that it is not desirable to make the length Lc of the horizontal deflection coil 51*a* large, as this makes the overall length of the color cathode ray tube apparatus 41 long, so that making the inner diameter Dc of the envelope surface small requires that the outer diameter of the neck part 48 be made small.

The making of the outer diameter of the neck part 48 small means that the outer diameter of the electron structure 50 housed therewithin would be made small, resulting in an increase in spherical aberration in the electron lens, this causing a deterioration in the focussing characteristics of the image.

For example, in accordance with Ludwig von Seidel's aberration theory, for a spherical aberration S1, a koma aberration S2, an astigmatism S3, an electron beam distance from the tube axis of Ya, and an electron gun structure radius of r, the following relationships obtain.

$$S1\ (Ya/r)^2$$

$$S2\ (Ya/r)^2$$

$$S3\ (Ya/r)^2$$

From the above relationships, by making the radius r of the electron gun structure 50 small, these aberrations S1, S2, and S3 increase, the result leading to a deterioration in the focussing characteristics.

If the outer diameter of the electron gun structure 50 is increased as much as possible, so that it approaches the inner diameter of the neck part 48, when a high voltage is applied sparking can be caused between the electron gun structure 50 and the neck part 48.

Because of this, in setting various parameters in the desire to obtain the best possible image, an accompanying increase in the deflection power occurs.

In recent years, color cathode ray tube apparatuses, and particularly for use as terminal displays for personal computers and other data equipment, are experiences demands for not only larger size, decreased thickness, higher intensity, and greater resolution, but also for a reduction in energy consumption.

To satisfy these market requirements, for example with regard to power consumption, in view of the above-noted equations, a method that can be envisioned is that of making any one of the horizontal deflection frequency fH, the envelope surface inner diameter Dc, the accelerating potential Eb, and the horizontal deflection angle θH small, or one of making the length Lc of the horizontal deflection coil large.

However, with the increased application of color cathode ray tube apparatus for displays, there have been increasing demands from the marketplace with regard to functional items such as increased size, thinness, high intensity, high resolution and the like, as well as with regard to quality, it has become impossible to satisfy these demands by merely pursuing extensions of existing technologies.

That is, the above-noted horizontal deflection frequency fH, the envelope surface inner diameter Dc, the accelerating potential Eb and the horizontal deflection angle θH all become large, this leading to a trend to an increase in the horizontal deflection power PH.

This being the situation, one approach is to accommodate this by the accelerating potential Eb that is applied to the electron gun structure 50, the length Lc of the horizontal deflection coil 51*a*, and the inner diameter Dc of the envelope thereof, which are adjustment factors.

For example, there has been a proposal for achieving operation with a small deflection power by making the boundary part of the funnel part and the neck part narrower than the outer diameter of the neck (refer to the Japanese Unexamined Patent Publication (KOKAI) No. 48-90673).

However, by making the outer diameter of the neck large so that the above-noted boundary part is relatively narrower, not only is a power savings not achieved, but also this proposal lacks practical usability, because of the increased difficult of attaching the deflection yoke.

Accordingly, in view of the drawbacks in the prior art as described above, a major object of the present invention is to provide a color cathode ray tube apparatus with a reduced power consumption, without sacrificing image quality.

A particular object of the present invention is to provide a color cathode ray tube apparatus in which the neck part is made of two parts having different outer diameters, a deflection yoke being disposed at a par thereof that has the smaller diameter.

Another object of the present invention is to provide a method of manufacturing a color cathode ray tube apparatus that includes the formation of a neck part having different outer diameters, and a method of attaching a deflection yoke.

Yet another object of the present invention is to provide a color cathode ray tube apparatus which, by the formation of the funnel part as a quadrangular pyramid shape, an improvement is obtained in the attachment of the deflection yoke to the color cathode ray tube.

In addition, an object of the present invention is to provide a color cathode ray tube apparatus which, by a proposed change in the shape of the deflection that has a reduced inner diameter of the envelope surface that is formed by the horizontal deflection coil of the deflection yoke, the degree of design freedom is improved, without causing a deterioration in the focussing characteristics, thereby enabling a great reduction in power consumption.

To achieve the above-noted objects, the present invention is a color cathode ray tube apparatus which is formed by a color cathode ray tube that has a panel part, onto the inside surface of which is formed a phosphor film for emission of three primary colors, a funnel part that has a funnel-shaped inclination, the expanded-size aperture side of which is joined to the above-noted panel part, and a neck part that is joined to the reduced-size aperture side of the funnel and which houses a electron gun structure that is arranged in in-line manner and which emits three electron beams that cause the phosphor film to emit light, and a deflection yoke which causes the deflection of the electron beams in the color cathode ray tube, wherein the neck part has a main part in which is housed the electron gun structure and a straight-tube reduced-diameter part having an outer diameter that is smaller than the main part of the neck part, and which is joined to the funnel part, and the deflection yoke having a horizontal deflection coil and a vertical deflection coil, a surface that is coaxial with and parallel to a longitudinal axis of said reduced diameter part and a opening inclined surface being formed on the inner envelope surface, these being disposed along the outer periphery of the straight-tube reduced-diameter part of the neck part and the funnel-shaped inclination of the funnel part.

More specifically, one end of the deflection yoke is fixed to one end of the outer peripheral surface main part of the neck part, the inner surface of the envelope of the deflection yoke being formed by the horizontal deflection coil so as to be coaxial and parallel to a longitudinal axis of said reduced diameter part, the inner diameter thereof being the same as or smaller than the outer diameter of the reduced-diameter part of the neck part.

The outer diameter of the reduced-diameter part of the neck part is preferably at least smaller than the tolerance of the outer diameter of the main part, and equivalent to or larger than the substantial inner diameter of the electron gun or outermost peripheral diameter of the electron beam trace, thereby enabling the swiveling of the deflection yoke, so as to facilitate adjustment.

More specifically, this is set to within the range of 95% to 75%, and the length of the reduced-diameter part is set at a length by adding an amount of play equivalent to the amount of movement for Integrated Tube Component (ITC) adjustment to the deflection yoke parallel surface length.

Additionally, the present invention is a color cathode ray tube apparatus is a color cathode ray tube which is formed by a color cathode ray tube that has a panel part on which is formed a phosphor film and a neck part that houses an electron gun structure, these being joined together by a funnel part, the neck part having a main part that houses the electron gun structure and a reduced-diameter straight-tube shaped part that is narrower than the main part, a connecting part between the above-noted parts, and being provided with a step part that is for the purpose of positioning the deflection yoke.

The connecting part of the neck part should be as short as possible, preferably should have a length of 10 mm or less.

Additionally, the present invention is a method of manufacturing a color cathode ray tube apparatus which is formed by a color cathode ray tube that has a panel part on which is formed a phosphor film and a neck part that houses an electron gun structure, these being joined by a funnel part, and a deflection coil that is attached thereto in the region of the joint between the neck part and the funnel part, this manufacturing method having a step of preparing two bulb members having differing outer diameters so as to be coaxial with the axis of the neck tube at the connection part of the neck part, and a step of butting these materials up against one another and fusing them together.

If necessary, it is possible to form a flare in the end of one of the two bulb members having differing outer diameters so that its outer diameter is nearly the same as the outer diameter of the other bulb member, this flare being butted up against and fused to the end of the other bulb member, thereby improving the accuracy and facilitating this joining process.

The present invention is also a method of manufacturing a color cathode ray tube apparatus that is formed by a color cathode ray tube that has a panel part on which is formed a phosphor film and a neck part that houses an electron gun structure, these being joined by a funnel part, and a deflection coil that is attached thereto in the region of the joint between the neck part and the funnel part, this manufacturing method having a step of preparing two bulb members having differing outer diameters so as to be coaxial with the axis of the neck tube at the connection part of the neck part, a step of inserting the bulb member having the smaller outer diameter into one end of the bulb member having the larger outer diameter by a prescribed length, and a step of fusing together the above-noted parts that are inserted and overlapping.

In addition, the present invention is a method of manufacturing a color cathode ray tube apparatus in which the deflection yoke is divided into a plurality of deflection coils, and preferably one in which it is assembled from a two parts, a horizontal deflection coil and a vertical deflection coil. More specifically, it is a method of manufacturing an improved color cathode ray tube apparatus in which the deflection yoke is formed from a dual horizontal deflection coil, held in sandwich fashion from top and bottom and a dual vertical deflection coil, held in sandwich fashion from left and right via a bobbin.

Another specific example of the present invention provides a color cathode ray tube apparatus that is formed by a color cathode ray tube that has a panel part, on the inner surface of which is formed a phosphor film for emitting light of three primary colors, a funnel part that has a funnel-shaped inclination and one of apertures of which is joined to said panel part, and a neck part that is joined to another aperture of said funnel part and which houses an in-line arranged electron gun structure that emits three electron beams which cause said phosphor film to emit light, and a deflection yoke which is disposed in the region of the joint between the funnel part and the neck part, and which causes deflection of the electron beams of the cathode ray tube, the neck part being formed by a main part that houses the electron gun structure and a reduced-diameter part that has a diameter that is smaller than the main part, the funnel part being formed as a quadrangular pyramid, and the deflection yoke being formed along the outer peripheral surface of the reduced-diameter part of the neck part and the outer surface of the quadrangular pyramid part of the funnel.

In this case, the deflection yoke is fixed via a wedge-shaped mounting fixture having an L-shaped inner surface that is matched to the outer shape of the quadrangular pyramid part.

DETAILED DESCRIPTION OF THE PREFERRED EMBODIMENTS

An embodiment of the a color cathode ray tube apparatus according to the present invention, as shown in FIG. 1 through FIG. 15, is formed by a color cathode ray tube and a deflection yoke attached thereto.

Of these elements, the color cathode ray tube is formed by a panel part which serves as a display screen, the inner surface thereof having formed on it a phosphor film, a funnel part which houses a shadow mask structure, the shadow mask structure being formed by a shadow mask and a frame, and a neck part which is made up of a main part and a reduced-diameter part, and which houses an electron gun structure that emits three electron beams.

The deflection yoke includes a horizontal deflection coil and a vertical deflection coil, and is disposed by a mounting means along the outer peripheral surface of the neck part in the region of the joint between the neck part and the funnel part along the outer peripheral surface of a funnel-shaped or quadrangular pyramid-shaped part.

Additionally, the electron gun structure is designed to have dimensions that enable it to be housed in the part of the neck part, and a length of the connection part connecting the reduced-diameter part to the main part of the neck portion, is set at a length as short as possible, in order to make the overall length of the cathode ray tube as short as possible.

By doing this, the color cathode ray tube apparatus according to the present invention avoids a lengthening of the overall length, and is able to achieve a practical effect in reducing power consumption without causing a deterioration in focussing characteristics and intensity characteristics.

Figure 1:
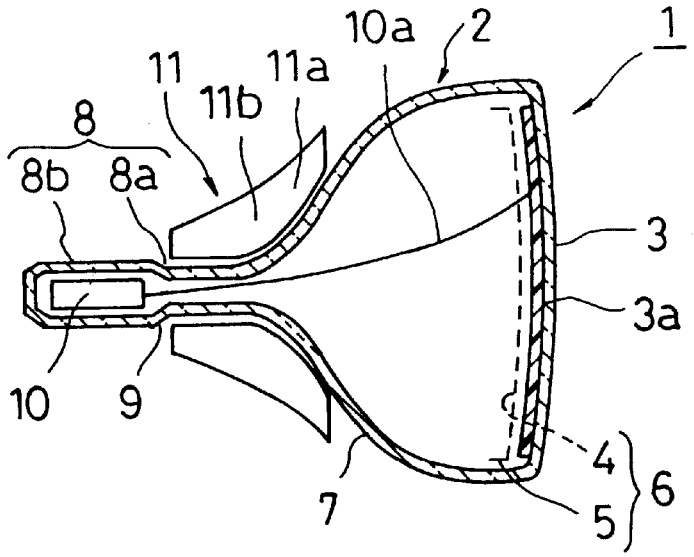
FIG. 1 is a cross-sectional view of the main parts of a color cathode ray tube apparatus according to an embodiment of the present invention.
Figure 2:
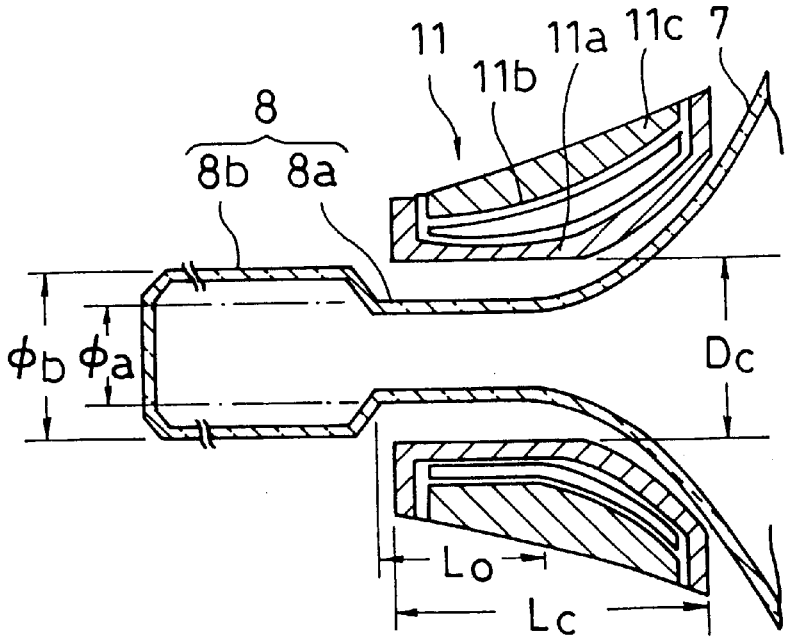
FIG. 2 is an enlarged partial cross-sectional view of the funnel part and the neck part of FIG. 1.

This embodiment of the present invention will be described in detail below, with reference being made to relevant drawings. FIG. 1 and FIG. 2 show the first embodiment of a color cathode ray tube apparatus according to the present invention, this color cathode ray tube apparatus being formed by a color cathode ray tube 1 that has a panel part 3, on the inner surface of which is formed a phosphor film 3*a* that emits three primary colors, a funnel part 7 which has a funnel-shaped inclination, a larger end of which is joined to the panel part 3, and a neck part 8, which is joined to the other, reduced-aperture end of the funnel part 7, and in which is disposed an electron gun having an in-line arrangement of cathodes which emit three electron beams boa so as to cause the phosphor film 3*a* to emit light, and a deflection yoke 11, which is disposed in the region of the joint part between the funnel part 7 and the neck part 8 so as to deflect the electron beams 10*a* of this color cathode ray tube 2.

The neck part 8 of the color cathode ray tube 1 is formed by a main part 8*b* which houses the electron gun structure 10, a straight-tube reduced-diameter part 8*a* which has a smaller diameter than the main part 8*b*, and which is joined to the funnel part 7, and a connection part 9, which connect two above-noted elements by welding method or the like.

The deflection yoke 11 includes a horizontal deflection coil 11*a*, a vertical deflection coil 11*b*, this being formed to have an overall length of Lc, the inside envelope surface of which is formed by a coaxial parallel surface and an expanding inclined surface, these being in opposition to the straight-tube reduced-diameter part 8*a*, which has a length of Lc, and the inclined part of the funnel part 7.

The outer diameter ϕa of the reduced-diameter part 8*a* a neck portion 8, and the outer diameter ϕb of the main part, with respect to the deflection coil inner diameter Dc, and preferably the diameter ϕa , has the relationship ϕb>Dc>ϕa, the outer diameter ϕa being established to be at least smaller than a small diameter side tolerance of the outer diameter ϕb, so that there is no interference presented with respect to the passage of an electron beam, this being set in the range from 93% to 77%.

For example, in the case in which the outer diameter ϕb of the main part 8*b* of the neck part 8 is 29 mm and the tolerance is 2 mm, the outer diameter ϕa of the reduced-diameter part 8*a* would be established in the range from 27 mm to 22 mm.

Furthermore, the inner diameter of the envelope surface of the deflection yoke can also be established so as to be Dc (equal to the diameter ϕb), which is the same as the outer diameter of the main part of the neck part, in which case a single-piece deflection yoke can be inserted via the outer diameter of the main part and attached at a prescribed position on the reduced-diameter part.

It is also possible to make the outer diameter dimension of the electron gun structure 10 larger than the inner diameter of the reduced-diameter part, so that almost all of it, with the exception of the auxiliary electrode part added to the end part thereof, is housed within the main part 8*b*, thereby contributing to an improvement in the focussing characteristics.

Additionally, the outer diameter ratio of the reduced-diameter part with respect to the main part can be set in the range from approximately 95% to 75%, so that swiveling of the deflection yoke is facilitated.

Figure 3:
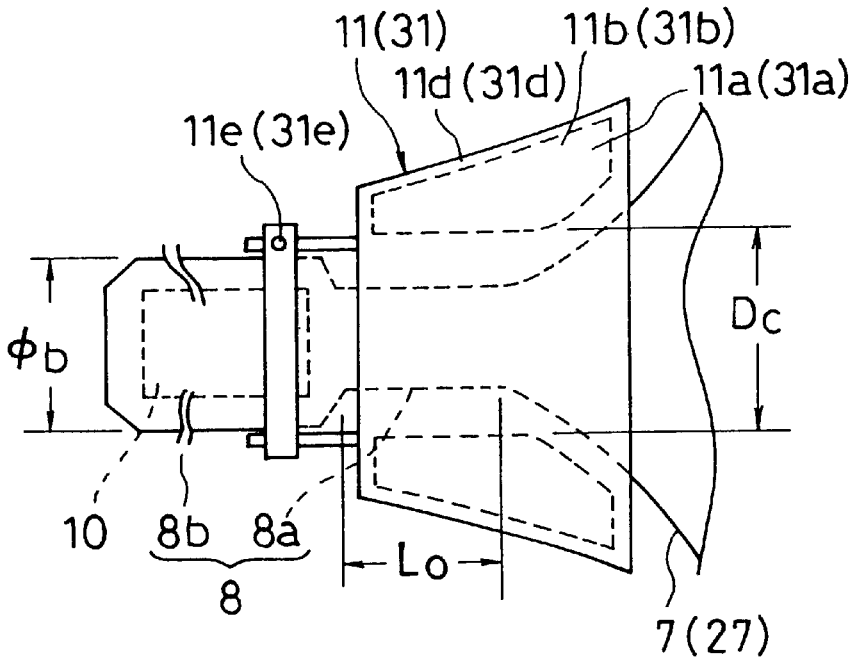
FIG. 3 is a simplified partial enlarged view that shows the mounting configuration for the deflection yoke of FIG. 1.
Figure 4:
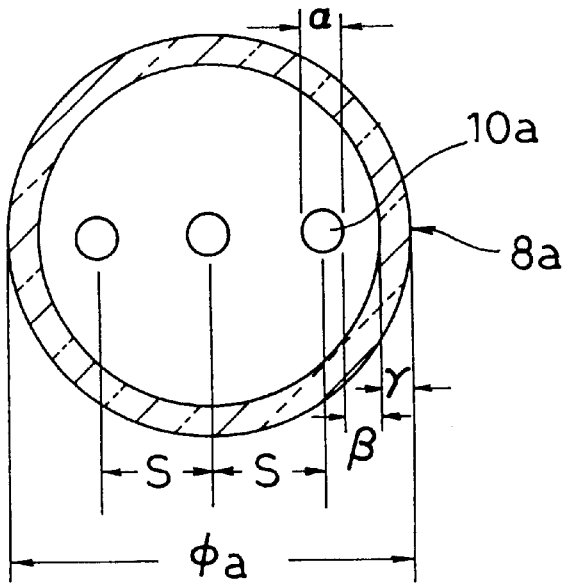
FIG. 4 is a partial enlarged view which illustrates the establishment of the outer diameter of the reduced-diameter part of the neck part.

The deflection yoke 11 is formed by a horizontal deflection coil 11*a* and a vertical deflection coil 11*b*, which are wound onto a toroidal bottom 11*d* and, as shown in FIG. 3, is disposed at a prescribed position on the outer peripheral surface of the reduced-diameter part 8*a* of the neck part 8, this being adjusted in a prescribed manner so that one end thereof is fixed above the outer peripheral surface of the main part 8*b* in which is housed the electron gun structure 10 utilizing a fixing screw 11*e* as shown in FIG. 3.

To achieve the best image purity, the deflection yoke 11 is adjusted so as to move it toward the electron gun structure side, and away from the point at which it makes contact up against the inclined outer surface of the funnel part 7. For the purpose of this type of ITC adjustment, the length Lo of the reduced-diameter part 8*a* of the neck part 8 is of a length that is the deflection yoke parallel length plus an amount of play that corresponds to the amount of movement that is required for the ITC adjustment.

Specifically, the length Lo of the reduced-diameter part 8*a* is a dimension that allows for a play for adjustment of 2 mm to 6 mm of the deflection yoke 11.

In the above-noted embodiment, the outer diameter of the reduced-diameter part 8*a* of the neck part 8 at which the deflection yoke 11 is disposed is in the range from approximately 27 mm to 22 mm.

This upper limit of 27 mm is, in consideration of the assembly accuracy of deflection yokes in the past, an achievable design, and is an upper limit that both enables achievement of power savings and facilitates the swiveling adjustment of the deflection yoke.

The value of 22 mm is a lower limit for the achievement of the maximum power savings effect. The basis for the limiting of the range of the outer diameter ϕa of the reduced-diameter part 8*a* is described below, with reference being made to FIG. 4.

The lower limit of the outer diameter ϕa of the reduced-diameter part 8*a* of the neck part 8 exhibits the following relationship.

$$\phi a=2S+\alpha+2\beta+2\gamma \quad (2)$$

In the above relationship, S is the distance from the center of the electron beam which passes through the reduced-diameter part of the tube to the electron beams on either side, α is the diameter of the electron beam that passes through the reduced-diameter tube, β is the distance from the outmost periphery of the electron beam to the inner wall of the reduced-diameter part, and γ is the thickness of the glass in the reduced-diameter part.

In terms of specific dimensions, the distance S between the center of the electron beam 10*a* emitted from the electron gun structure 10 an the electron beam on either side is taken to be, for example, 5.6 mm, in which case the diameter α of the electron beam 10*a* is approximately 2 mm.

The distance β from the outside electron beam 10*a* and the inner wall surface is required to be 2.35 mm, so that the electron beam 10*a* does no approach the inner wall too closely, thereby causing a worsening of the display characteristics caused by convergence drift. Additionally, the glass thickness γ of the reduced-diameter part is approximately 2.3 mm.

From these dimensions, the lower limit of the outer diameter ϕa of the reduced-diameter part 8*a*, from Equation (2), is calculated as 22.5 mm, so that, considering the tolerance, this is made approximately 22 mm.

The outer diameter of the neck part is usually made 29.1 mm, when this dimension is taken as the outer diameter ϕb of the main part 8 , the upper limit of the outer diameter ϕa of the reduced-diameter part 8*a* is determined.

To achieve the object of the present invention of an electrical power savings of a number of percent, it is seen from the above-noted Equation (1) that it is necessary to make the inner diameter Dc of the horizontal deflection coil 11*a* be smaller by approximately 2 mm.

Therefore, the upper limit of the outer diameter ϕa of the reduced-diameter part 8*a* becomes 27.1 mm, and approximately 95% with respect to the outer diameter of the main part is set as the upper limit.

From this, the outer diameter ϕa of the reduced-diameter part 8*a* can be established in the range of approximately 22 mm to approximately 27 mm, this being approximately 95% to 75% with respect to the outer diameter of the main part of the reduced-diameter part, thereby achieving power savings in the range from 6% to 30%.

Furthermore, to ensure focussing characteristics, even in a case in which an electron gun structure having a large outer diameter is used, as long as the spacing of the electron beams at the center and each side is below the above-described relationship of 5.6 mm, it is possible to adopt the above-noted ratio range.

Next, another embodiment of the present invention will be described, this being a method of manufacturing a color cathode ray tube apparatus having a neck part with different outer diameters, with reference being made to FIG. 5.

The color cathode ray tube 2 is formed by a panel part 3 onto which is formed a phosphor film 3*a*, a neck part 8 within which is housed an electron gun structure 10 that causes the phosphor film 3*a* to emit light, and a funnel 7 by which the screen part 3 and the neck part 8 are connected.

The neck part 8 has a main part 8*b* within which is housed the electron gun 10 and a reduced-diameter straight-tube part 8*a* which has a smaller diameter than the main part 8*b*, the main part 8*b* and the reduced-diameter part 8*a* being connected by a connecting part 9.

It is understood that it is necessary to make the length Ls of the connecting part 9 of the main part 8*a* and the reduced-diameter part 8*b* as short as possible, thereby preventing a lengthening of the overall length of the apparatus. Specifically, it is determined that this connecting part 9 is preferably made no longer than 10 mm.

Figure 5:
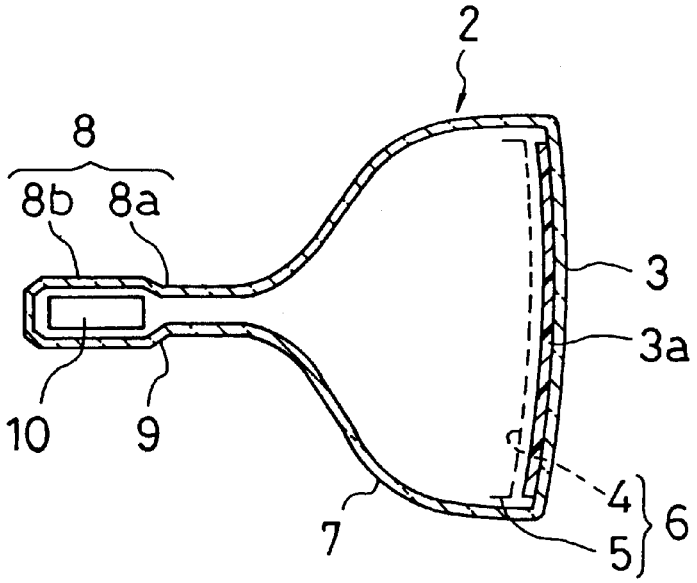
FIG. 5 is a cross-sectional view of the main part of the color cathode ray tube of FIG. 1.

A method manufacturing for a neck part 8 of a color cathode ray tube as shown in FIG. 5, in which the neck part 8 has a reduced-diameter part 8*a* and a main part 8*b* with different outer diameters, with reference being made to FIG. 6 through FIG. 10.

Figure 6:
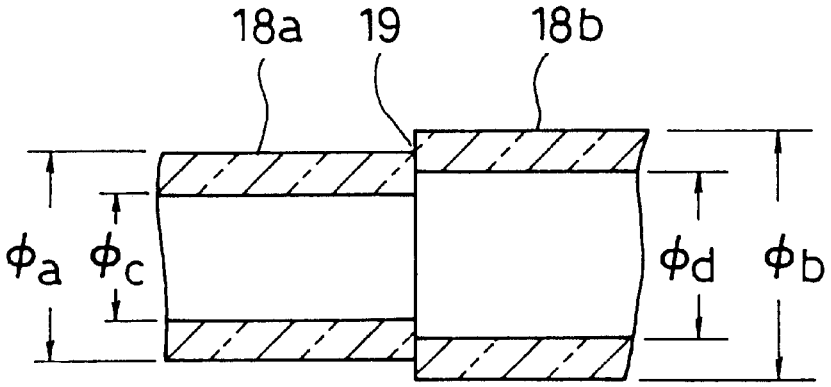
FIG. 6 is a cross-sectional view of the main part of an embodiment of a method of manufacturing a color cathode ray tube according to the present invention.

In the method of manufacturing the neck part, as shown in FIG. 6, bulb members having different outer diameters for the reduced-diameter part bulb member 18*a* and the main part bulb member 18*b* are prepared.

The ends of these two bulb members are butted together and joined by means of heating by a gas burner. That is, there is a step by which the two bulb members having different outer diameters are prepared so as to be coaxial with respect to the center of the tube axis, the faces of the ends thereof being butted up against each other, and a step by which heating centered about the joining line 19 is done so as to fused these two elements together.

Figure 8:
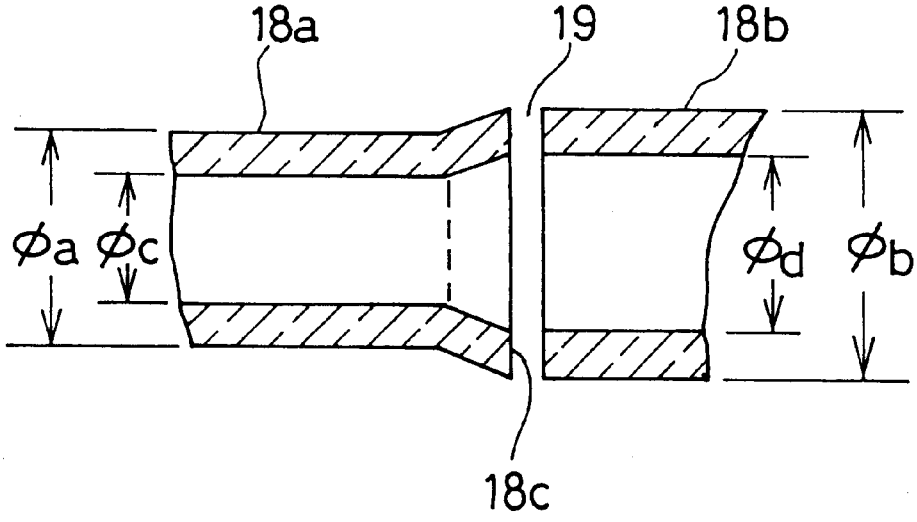
FIG. 8 is a cross-sectional view of the main part of the method of connecting the neck part, which shows first example of a variation of FIG. 6.
Figure 9:
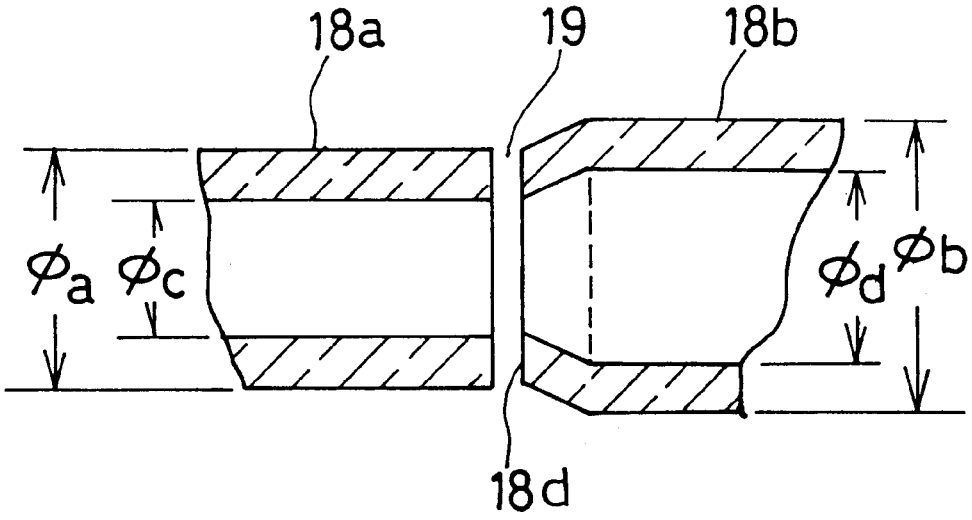
FIG. 9 is a cross-sectional view of the main part of the method of connecting the neck part, which shows a second example of a variation of FIG. 6.

A variation of this, as illustrated in FIG. 8 and FIG. 9, is one in which a flare 18*c* (or 18*d*) is formed in one of the two bulb members 18*a* and 18*b*. That is, the method of manufacture in this embodiment has a step of forming a flare in either the bulb member 18*a* or the bulb member 18*b* beforehand. By doing this, the butting of the two materials up against one another is facilitated.

Figure 7:
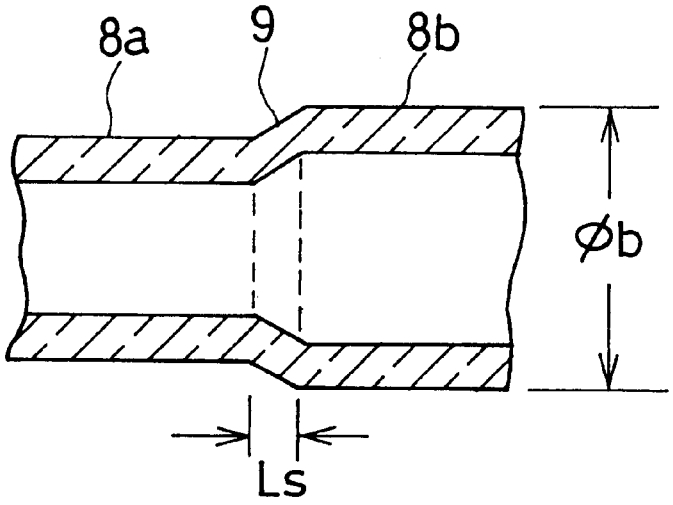
FIG. 7 is a cross-sectional view of the main part of the neck part of FIG. 6 after completion of fusing.

The connecting part 9 of the neck part 8, as shown in FIG. 7, is completed by butting the ends of the reduced-diameter part 8*a* and the main part 8*b* up against each other in opposition, about the neck tube axis as a center, and fusing them together.

That is, the connection between the reduced-diameter part 8*a* and the main part 8*b* is achieved by butting the glass material of the bulb member 18*a* and 18*b* of each of these elements up against each other in mutual opposition, and heating them with a gas burner or the like to fuse them together.

When heating them with a gas burner, because pressure is applied in the inner-pointing radial direction, this step is performed the inside of the tubes of the bulb member filled with a gas having nitrogen as its main component, thereby increasing the pressure within the tubes.

According to this method, after completion, at the connection part 9 between the reduced-diameter part 8*a* and the main part 8*b*, because of the heat applied by the gas burner, the outer diameter ϕb of the main part 8 is pushed toward the inside and fused with the outer diameter ϕa of the reduced-diameter part.

Additionally, because of the action of the pressure of the gas within the tubes, the inner diameter ϕc of the reduced-diameter part is pushed toward the outside, so that it is fused with the inner diameter ϕd of the main part. After fusion, therefore, the connecting part 9 does not become larger than the outer diameter ϕb of the main part 8*b*.

FIG. 8 and FIG. 9 show variations in the method of butting, in which a flare 18*d* is formed in either the reduced-diameter side bulb member 18*a* or the main part side bulb member 18*b*, the outer diameter being caused to coincide with the tubes butted up against one another so as to coincide with the outer diameter of this flare 18*c* (or 18*d*).

In the variation that is shown in FIG. 8, an expanding funnel-shaped flare 18*c* is formed in one end of the reduced-diameter part 18*a*, the outer diameter thereof being made the same as the outer diameter ϕb of the main part bulb member 18*b*. The connection part 19 is of a shape that does not become larger than the outer diameter ϕb of the main part.

In the variation that is shown in FIG. 9, a reducing funnel-shaped flare 18*d* is formed in one end of the main part 18*b*, the outer diameter-thereof being made the same as the outer diameter ϕb of the reduced-diameter part bulb member 18*b*.

In these cases, the connecting part 19 between the two bulb members is formed by butting the two up against each other and fusing them together, and in both cases the length Ls of the connecting part 9 that fuses together the reduced-diameter part 8*a* and the main part 8*b* is preferably limited to a length of 10 mm or shorter.

Figure 10:
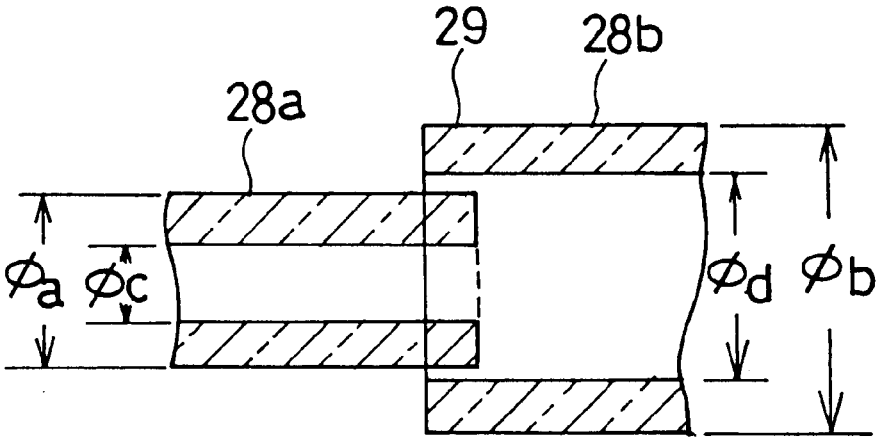
FIG. 10 is a cross-sectional view of the main part of an embodiment that differs from the method of manufacturing shown in FIG. 6.

In a different embodiment, as shown in FIG. 10, the outer diameter ϕa of the reduced-diameter bulb member 28*a* is prepared so as to be smaller than the inner diameter ϕd of the main part side bulb member 28*b*.

In this case, the connecting part of the neck part is formed by inserting the end part of the reduced-diameter side bulb member 28*a* along the axis of the tube into the main part side bulb member 28*b* so that the two materials overlap by a prescribed length, this overlapping section being then fused together.

The overlapping region becomes the connecting part, and with the reduced-diameter side bulb member 28*a* and main part side bulb member 28*b* in an overlapping condition, a gas having nitrogen as its main component is fed into the tubes, thereby increasing the pressure therewithin, and a gas burner is used to apply heat from outside so as to fuse the tubes together.

According to this method, after completion the connecting part 9 between the reduced-diameter part 8*a* and the main part 8*b*, fusion occurs by the balance between the thermal force applied from outside by the gas burner and the pressure within the tubes caused by the gas fed into the tubes, the connecting part 9 after completion being no greater than the outer diameter ϕb of the main part 8*b*.

Next, to improve the deflection sensitivity, the an ideal horizontal deflection coil 11*a* for the outer diameter ϕa of the reduced-diameter part 9*a* of the neck part 8 is formed so that the inner envelope surface has a small inner diameter Dc.

This inner diameter Dc is preferably smaller than the outer diameter ϕb of the main part 8*b* of the neck part 8, with the deflection yoke 11 being a split-type yoke. That is, because it becomes impossible to insert this from the main part 8*b* of the neck part 8, the attachment of the deflection yoke 11 is done by assembling components that form the deflection yoke.

Furthermore, it is obvious that by making the inner diameter Dc of the horizontal deflection coil 11*a* small the inner diameter of the vertical deflection coil 11*b* also becomes small.

Figure 11:
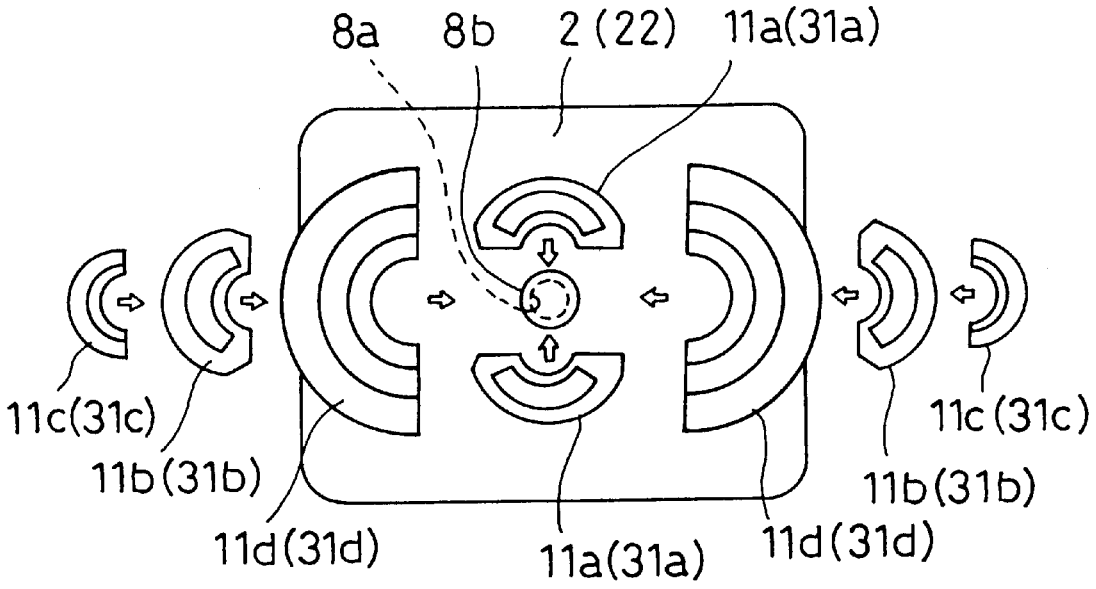
FIG. 11 is a simplified drawing of the main part of the attachment of the deflection yoke in another embodiment of the present invention.

In a case in which the inner diameter Dc of the horizontal deflection coil 11*a* is made smaller than the outer diameter of the main part 8*b* of the neck part 8, as shown in FIG. 11, the attachment of the deflection yoke 11 onto the reduced-diameter part 8*a* of the neck part 8 is done by attaching the double-split horizontal deflection coils 11*a* and double-split vertical deflection coils 11*b*, and the like.

For example, the deflection yoke 11 of the color cathode ray tube 2 is assembled at a prescribed position from the pair of split horizontal deflection coils 11*a* and the pair split vertical deflection coils 11*b*.

More specifically, the deflection yoke 11 that is disposed on the reduced-diameter part 8*a* of the neck part 8 is assembled by the pair of horizontal deflection coils 11*a* from top and bottom and the pair of vertical deflection coils 11*b* from left and right surrounding in a sandwiching manner the reduced-diameter part 8*a*, with intervening bobbins 11*d*.

The pair of bobbins 11*d* has grooves in the outer and the inner surfaces thereof, respectively, the horizontal deflection coils 11*a* and the vertical deflection coils 11*b* being therein at prescribed positions. Additionally, a pair of cores 11*c* is mounted so as to surround the horizontal deflection coils 11*a* and the vertical deflection coils 11*b* from the left and right.

These cores are formed as one with the bobbin, by means of a core joining fixture and mating pin. The various constituent components of the horizontal deflection coils 11*a*, the vertical deflection coils 11*b*, and the cores 11*c* are adhered and assembled to the bobbins 11*d* using an adhesive agent or the like, thereby forming the deflection yoke 11 which, as shown in FIG. 3, is fixed to the outer peripheral surface of the main part 8*b* of the neck part 8 by a mounting screw.

The preceding has been merely one example of mounting a deflection yoke 11 to a color cathode ray tube 2, and it is of course possible to pre-assemble the various elements of the deflection yoke 11 before final mounting.

Figure 12:
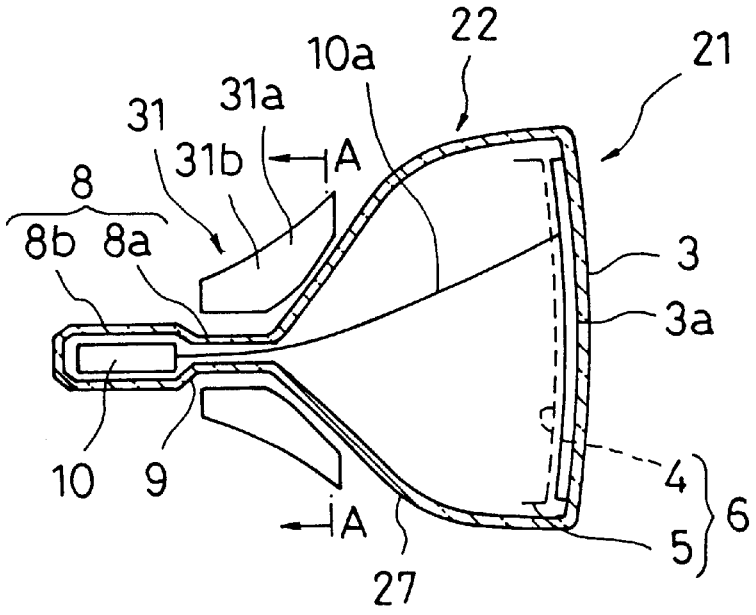
FIG. 12 is a cross-sectional view of the main part of a color cathode ray tube apparatus of another embodiment of the present invention.
Figure 13:
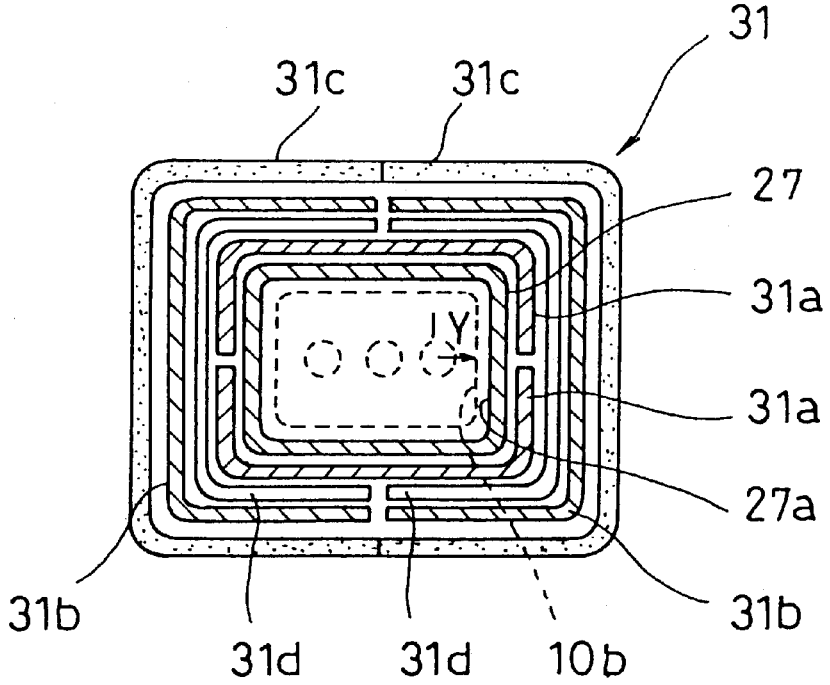
FIG. 13 is a cross-sectional view of the color cathode ray tube apparatus of FIG. 12 as seen from the direction indicated as A—A.

Next, yet another embodiment of the present invention will be described, with reference being made to FIG. 12 and FIG. 13, this embodiment being one in which a funnel with a specific shape, in this case a so-called quadrangular pyramid funnel, is used.

A color cathode ray tube according to this embodiment has a neck part 8 that is formed by a main part 8*b* within which is housed an electron gun structure 10, and a straight-tube reduced-diameter portion having a smaller diameter than the main part 8*b*, and which is joined to the funnel part 27. A feature of this embodiment is that funnel part 27 has a square-shaped inclined part.

The deflection yoke 31, which is attached to the reduced-diameter part 8*a* of the neck part 8 is disposed at a square inclined part of the funnel part 27 over a length that is required for deflection, up to the end of the horizontal deflection coil 11*a* at the panel side 3.

That is, the funnel that is used has an inclined part that opens to the quadrangular pyramid part and an inclined part from the end of this part to the panel 3.

The deflection yoke 31, which is formed by the horizontal deflection coil 31*a*, the vertical deflection coil 31*b*, and the toroidal bobbin 31*d* and the like has a parallel surface that is disposed in parallel with and coaxially to the reduced-diameter part 8*a* and an inclined surface along the funnel part 27, and is disposed in a space between the outer periphery of the reduced-diameter part 8*a* and the outer surface of the inclination of the funnel part 27.

The inner surface shape of the horizontal deflection coil of the deflection yoke 31 is formed in the shape of a rectangle along the quadrangular pyramid-shaped funnel part's outer surface.

As shown by the cross-section of the quadrangular pyramid inclined part of the funnel part 27 and the cross-section of the constituent parts of the quadrangular pyramid-shaped parts of the funnel part 27 (refer to FIG. 13), the spacing Lr that exists between the inner wall 27*a* of the quadrangular pyramid-shaped part of the funnel part 27 and the outermost peripheral position 10 of the path of passage of the electron beam that is emitted from the electron gun structure is pre-selected as a prescribed value, so that the outermost peripheral passage path of the electron beam 10*a* from the electron gun structure 10 is approximately 2 mm to 4 mm distance from the inner wall 27.

The use of a deflection yoke 31 that has a shape that follows along the outer periphery of the reduced-diameter part 8*a* and along the outer shape quadrangular pyramid shape of the funnel part 27 causes envelope surface that is parallel to the axis that is formed by the horizontal deflection coil 31*a* and the vertical deflection coil 31*b* to approach the electron beam 10*a*.

As a result, the deflection sensitivity is improved, and it is possible to reduce the horizontal deflection power PH by approximately 15%. Furthermore, as described above, because a the inner surface 27*a* of the quadrangular pyramid funnel part 27 spaced by 2 mm to 4 mm from the outermost peripheral position of the path of passage of the electron beam 10*b*, the electron beam 10*a* is not influenced by the outer wall of the funnel part 27.

The method of mounting the deflection coil on the electron gun side is the same in this method of manufacturing as shown in FIG. 3.

By using a combination a square cone and reduced-diameter neck to improve the deflection sensitivity, or by making the inner diameter Dc of the horizontal deflection coil envelope surface with respect to the outer diameter $\phi a$ of the reduced-diameter part outer diameter $\phi b$ of the main part smaller than the outer diameter of the main part, it is possible to achieve a reduction in the horizontal deflection power of up to approximately 50%.

Next, the mounting of a deflection yoke to a color cathode ray tube having a funnel part which opens to a quadrangular pyramid shape and the spacing between the funnel part and the deflection yoke will be described next.

The deflection yoke 31 is attached to the reduced-diameter part 8*a* of the neck part 8 of the color cathode ray tube 22 and this deflection yoke is held in place by a wedge-shaped mounting fixture that has an L-shaped inner surface shape that matches the shape of the outer surface of the funnel part that opens to the quadrangular pyramid. This mounting fixture has an arc shape and an L shape that match the shape of the inner surface of the horizontal deflection yoke 31*a*.

Figure 14A:
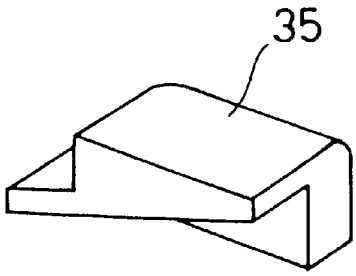
FIG. 14 is a perspective view and a cross-sectional view which illustrate the mounting fixture for the deflection yoke of FIG. 12.
Figure 14B:
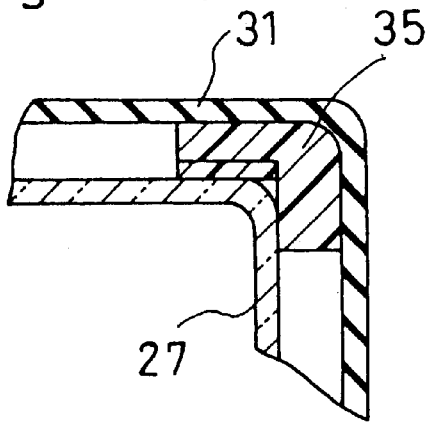

As shown in FIG. 14, an embodiment of this mounting fixture is a mounting fixture 35 that is matched to the combination of the funnel part 27 that has a quadrangular pyramid shape and the deflection yoke 31, which has a rectangular inner surface.

This mounting fixture 35 has an approximately right-angled L shape that is matched to the inner surface shape of the coil that forms the horizontal deflection coil 31*a* which forms the deflection yoke 31. The deflection yoke 31 is attached to the reduced-diameter part 31, and this mounting fixture 35 is inserted in the four corners, between the funnel part 27 and the deflection yoke 21.

Figure 15A:
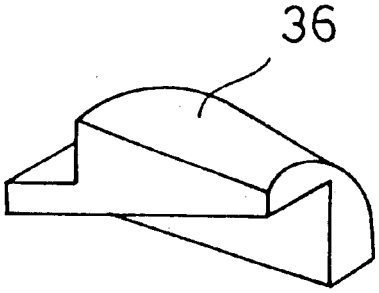
FIG. 15 is a perspective view and a cross-sectional view which illustrate the mounting fixture for the deflection yoke of FIG. 12.
Figure 15B:
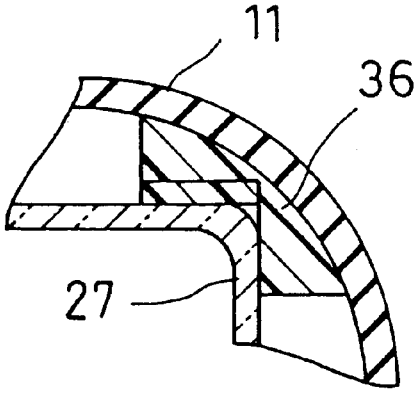
Figure 16:
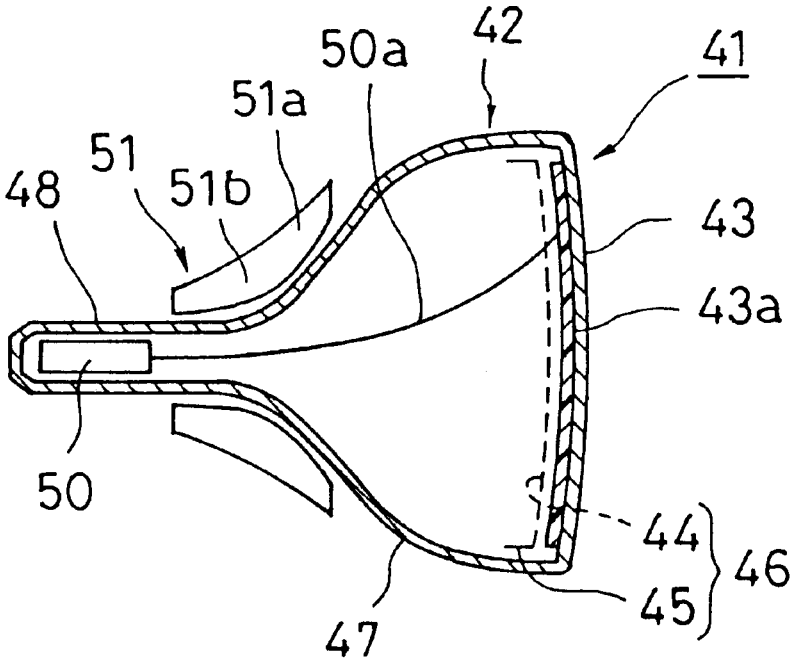
Fig. 16 PRIOR ART
FIG. 16 is a cross-sectional view of the main part of a color cathode ray tube apparatus of the past.
Figure 17:
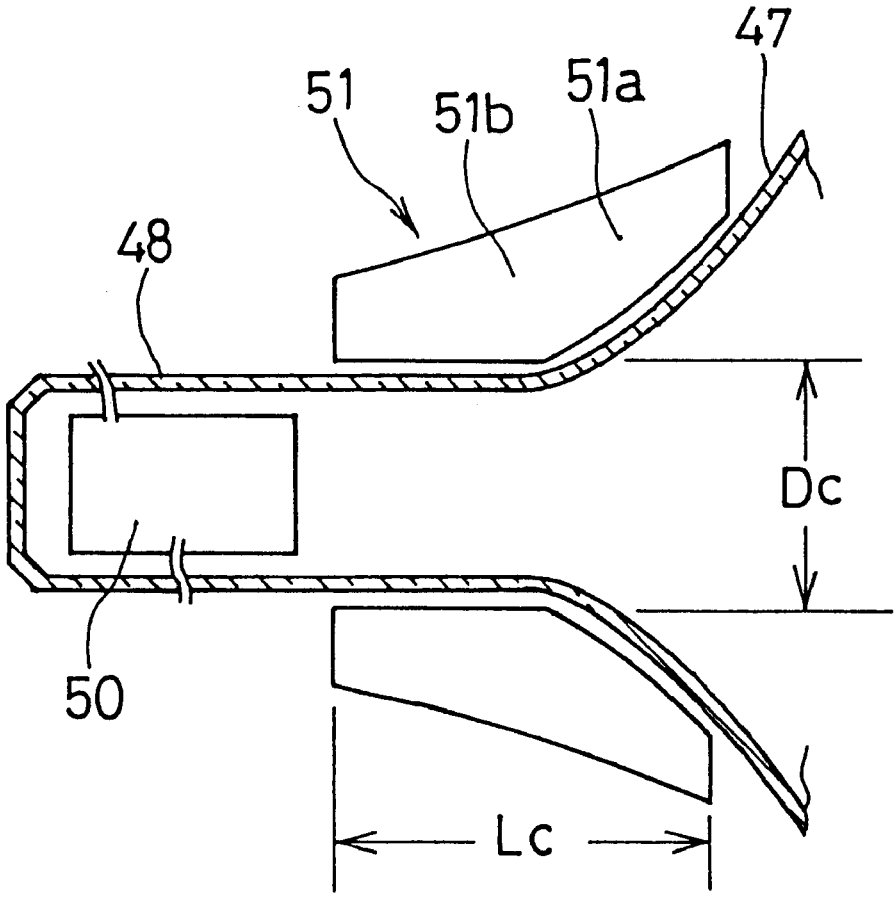
Fig. 17 PRIOR ART
FIG. 17 is a partial enlarged cross-sectional view of the funnel part and the neck part of FIG. 16.

In a different embodiment, as shown in FIG. 15, the mounting fixture is the mounting fixture 36, which is matched to the combination of the funnel part 27 that has a quadrangular pyramid shape and the deflection yoke 11 that is formed by a horizontal deflection coil and vertical deflection coil that have round inner surfaces as seen in the type used in the past.

The shape of the inner surface of this mounting fixture 36 is an approximately right-angled L shape that is matched to the outer surface shape of the funnel part 27 that opens to the quadrangular pyramid shape, and the outside shape matches an arc shape, that is, the circular shape of the inner surface of the coil that is formed by the horizontal deflection coil that forms the deflection yoke 11. The deflection yoke 11 is attached to the reduced-diameter part of the neck part, and the mounting fixtures 36 are inserted at the four corners, between the funnel part 27 and the deflection yoke 11.

The shapes of the inner and outer surfaces of the mounting fixtures 35 (or 36) of the above-described deflection yoke 31 (or 11) are matched to the outer surface shape of the funnel part and the inner surface shape of the horizontal deflection coil, and has a wedge shape that matches the shape of the spacings between the funnel part and the deflection yoke.

Furthermore, in the above-described embodiments, although the mounting fixtures 35 (and 36) are inserted at the four corners, between the funnel part and the deflection yoke, they can be used at only two locations in the case of a small color cathode ray tube.

A color cathode ray tube apparatus according to the present invention has a neck part having two parts with different outer diameters, the deflection yoke position being established at the reduced-diameter part, with the function of housing the electron gun structure being shared by the main part as well, making this apparatus highly practical for use as a power-saving display.

In particular, the mounting of the deflection yoke on the reduced-diameter part is done to make efficient use of the deflection power, thereby greatly reducing the overall power consumption of the apparatus. The proposal of a method of manufacturing a color cathode ray tube apparatus according to the present invention for the purpose of improving ease of manufacturing not only facilitates embodiment, but also is advantageous from the standpoint of achieving good quality.

Additionally, by forming an inclination on the quadrangular pyramid shape of the funnel part, it is possible to achieve a significant improvement in deflection without increasing the anode voltage, and to reduce the horizontal deflection power that is required.

That is, a color cathode ray tube apparatus according to the present invention, including this apparatus as described in the embodiments noted above, enables the achievement of a 6% to 30% improvement in power consumption over an apparatus like this of the past, and enables a reduction of power consumption of approximately 50% for the case of using the optimum combination, without causing a deterioration of the focussing and intensity characteristics, which are important factors in practical use thereof, thereby making the apparatus useful as a power-saving display apparatus, with high practical usefulness in a wide range of industrial fields.

What is claimed is:

1. A color cathode ray tube apparatus comprising color cathode ray tube, said cathode ray tube comprising:

a panel part having on its inside surface a phosphor film that emits three primary colors;

a funnel-shaped funnel part, an expanded aperture of which is joined to said panel part; and a neck part that is joined to a reduced-aperture part of said funnel part and which houses an in-line arranged electron gun structure that emits three electron beams which cause said phosphor film to emit light, and a deflection yoke which deflects the electron beams in said color cathode ray tube, wherein said neck part comprises a main part that houses said electron gun structure and a reduced-diameter straight tube like part that has a diameter that is smaller than said main part and that is joined with said funnel part, said deflection yoke comprising a horizontal deflection coil and a vertical deflection coil, the envelope surface of said deflection yoke forming a coaxial parallel surface to a longitudinal axis of said reduced-diameter straight tube like part and an expanding inclined surface, and said deflection yoke being disposed along an outer surface of said reduced-diameter part and along said funnel inclination while maintaining a space between the outer surface of the reduced diameter part and the deflection yoke, and between the funnel inclination and the deflection yoke to increase image purity, and further wherein said outer diameter of said reduced-diameter part of said neck part is smaller than the outer diameter of said main part and larger than the outermost periphery of a path of an electron beam that is emitted from said electron gun structure, said outer diameter of said reduced-diameter part $\phi a$ being established in the range from approximately 95% to approximately 75% of the outer diameter of said main part.

2. A color cathode ray tube apparatus according to claim 1, wherein the envelope surface of said deflection yoke forms a coaxial parallel surface to a longitudinal axis of said reduced-diameter straight tube like part by means of said horizontal deflection coil, the inner diameter of which is smaller than the outer diameter of said main part of said neck part.

3. A color cathode ray tube apparatus according to claim 2, wherein the length of said reduced-diameter part is set at a length by adding an amount of play equivalent to the amount of movement for ITC adjustment to the deflection yoke parallel surface length.

4. A color cathode ray tube apparatus according to claim 1, wherein one end of said deflection yoke is fixed to an outer peripheral surface of one end of said main part of said neck part.

5. A color cathode ray tube apparatus comprising a color cathode ray tube, said cathode ray tube comprising:

a panel part on which is formed a phosphor film;

a neck part which houses an electron gun structure;

a funnel part which connects said panel part and said neck part; and a deflection yoke which is attached in a region of a joint between said neck part and said funnel part, wherein said neck part has a main part that house said electron gun structure and a reduced-diameter straight tube like part that is thinner than said main part, and connection part between these elements, and further being provided with a step at which said deflection yoke is attached, and further wherein said outer diameter of said reduced-diameter part of said neck part is smaller than the outer diameter of said main part and larger than the outermost periphery of a path of an electron beam that is emitted from said electron gun structure, said outer diameter of said reduced-diameter part $\phi a$ being established in the range from approximately 95% to approximately 75% of the outer diameter of said main part.

6. A color cathode ray tube apparatus according to claim 5, wherein said connecting part of said neck has a length no greater than 10 mm.

7. A color cathode ray tube apparatus according to claim 5, wherein said deflection yoke is assembled from a dual split horizontal deflection coil and a dual split vertical deflection coil.

8. A color cathode ray tube apparatus according to claim 7, wherein said deflection yoke is formed from a dual horizontal deflection coil, held in sandwich fashion from top and bottom making said straight tube like part put into a center thereof and a dual vertical deflection coil, held in sandwich fashion from left and right making said straight tube like part put into a center thereof, via a bobbin.

9. A color cathode ray tube apparatus comprising:

a color cathode ray tube, said ray tube comprising, a panel part having on its inside surface a phosphor film that emits three primary colors, a funnel-shaped part, an expanded aperture of which is joined to said panel part, and a neck part that is joined to a reduced-aperture part of said funnel part which houses an in-line arranged electron gun structure that emits three electron beams which cause said phosphor film to emit light; and a deflection yoke which deflects the electron beams in said color cathode ray tube, wherein a portion of said funnel part which is connected to said neck part is formed by a quadrangular pyramid part, and further wherein an outer aperture of a reduced aperture part of said neck part is smaller than the outer aperture of a main part of said neck part and larger than the outermost periphery of a path of an electron beam that is emitted from said electron gun structure, said outer aperture of said reduced aperture part of said neck part $\phi a$ being established in the range from approximately 95% to approximately 75% of the outer aperture of said main part.

10. A color cathode ray tube apparatus according to claim 9, wherein there is provided a straight-tube reduced aperture part between a main part of said neck part and said funnel part and further wherein said straight-tube reduced aperture part has a rectangular cross sectional configuration corresponding to that of said quadrangular pyramid part.

11. A color cathode ray tube apparatus according to claim 10, wherein said deflection yoke comprising a horizontal deflection coil and a vertical deflection coil, and wherein said horizontal deflection coil is arranged so that a magnetic field generated from said horizontal deflection coil affects the electron beams emitted from said electron gun structure much stronger than that generated from said vertical deflection coil.

12. A color cathode ray tube apparatus according to claim 11, wherein said rectangular cross sectional configuration at least of said straight-tube reduced-diameter part having a long side portion parallel to a direction along which said three electron gun structures are arranged.

13. A color cathode ray tube apparatus according to claim 12, wherein a main part of said horizontal deflection coil is arranged in parallel with said long side portion of said rectangular shape in said cross sectional configuration of said straight-tube reduced-diameter part.

14. A color cathode ray tube apparatus according to claim 11, wherein horizontal deflection coil is attached to said straight-tube reduced-diameter part and said quadrangular pyramid part of said funnel part, first and thereafter said vertical deflection coil is attached thereto later.

* * * * *